US005765535A

United States Patent [19]

Radermacher

[11] Patent Number: 5,765,535

[45] Date of Patent: Jun. 16, 1998

[54] FUEL SUPPLY SYSTEM FOR INTERNAL COMBUSTION ENGINES

[75] Inventor: Bernhard Radermacher, Viersen, Germany

[73] Assignee: Pierburg AG, Neuss, Germany

[21] Appl. No.: 618,939

[22] Filed: Mar. 20, 1996

[30] Foreign Application Priority Data

Mar. 23, 1995 [DE] Germany ..... 195 10 494.3

[51] Int. Cl.[6] ..... F02M 41/00; F02M 37/04

[52] U.S. Cl. ..... 123/497; 123/456

[58] Field of Search ..... 123/456, 497, 123/498, 499, 447

[56] References Cited

U.S. PATENT DOCUMENTS

| | | | |
|---|---|---|---|
| 1,404,152 | 1/1922 | Rettering | 123/497 |
| 1,580,489 | 4/1926 | Hunt | 123/497 |
| 4,359,984 | 11/1982 | Nakao | 123/497 |
| 4,800,859 | 1/1989 | Sagisaka | 123/497 |
| 4,919,102 | 4/1990 | Iwabuchi | 123/497 |
| 4,920,942 | 5/1990 | Fujimori | 123/497 |
| 5,133,323 | 7/1992 | Treusch | 123/494 |
| 5,231,967 | 8/1993 | Baltz | 123/497 |
| 5,237,975 | 8/1993 | Betki | 123/497 |
| 5,265,644 | 11/1993 | Tuckey | 137/510 |
| 5,337,718 | 8/1994 | Tuckey | 123/497 |
| 5,398,655 | 3/1995 | Tuckey | 123/456 |
| 5,509,390 | 4/1996 | Tuckey | 123/497 |

FOREIGN PATENT DOCUMENTS

| | | |
|---|---|---|
| 0264556 | 4/1988 | European Pat. Off. . |
| 3102983 | 4/1982 | Germany . |
| 2142459 | 3/1993 | Germany . |
| 4332446 | 3/1994 | Germany . |
| 61-72865 | 4/1986 | Japan . |
| 9610693 | 11/1996 | WIPO . |

*Primary Examiner*—Carl S. Miller
*Attorney, Agent, or Firm*—Ladas & Parry

[57] ABSTRACT

A fuel supply system for an internal combustion engine in which an electrical fuel pump pumps fuel from a fuel tank to a fuel distributor and a pressure switch is connected to respond to the pressure of the fuel. The pressure switch is electrically connected to connect and disconnect electrical power supply to the fuel pump as a function of lower and upper threshold values of pressure of the pumped fuel. The pressure switch contain a storage chamber which stores fuel when the fuel pump is operative and when the pump is disconnected, the storage chamber supplies the stored fuel to the full distributor with no back flow to the fuel tank. A pressure reducing regulator is located between the pressure switch and the fuel distributor to reduce the pressure of the fuel supplied to the distributor to a value lower than the pressure of the fuel at the pressure switch.

9 Claims, 2 Drawing Sheets

FUEL SUPPLY SYSTEM FOR INTERNAL COMBUSTION ENGINES

FIELD OF THE INVENTION

The invention relates to a method and apparatus for pumping fuel from a fuel tank to a fuel distributor of an internal combustion engine and more particularly to the pumping of fuel via a pressure switch which controls operation of a fuel pump.

BACKGROUND AND PRIOR ART

In conventional systems provided with a fuel pump and a pressure regulator, the pressure regulator is arranged downstream of the fuel distributor and excess fuel flows back into the fuel tank.

Fuel pumps of large capacity operate in this way against a controlled fuel pressure. At prolonged operation of the internal combustion engine under partial load or when the fuel tank is close to empty, fuel heated by the hot engine is transported back into the tank in large quantities, whereby increased vapor pressure and gas bubbles may be formed in the fuel aspirated by the pump.

DE 43 32 446 discloses a pressure switch inserted between the fuel pump and the fuel distributor for switching between on-off states as a function of the pump outlet pressure. In this way the fuel pump is supplied with a variable electrical power by means of a control circuit, if the pump outlet pressure goes above or below threshold values of the pressure switch.

In this device, no fuel return to the fuel tank is provided. However, a large fluctuation of the pump outlet pressure is obtained due to the required switching operation.

DE 31 02 983 discloses a device for control of fuel input to an internal combustion engine, in which a pressure regulator adjusts a switch/resistance by the quantity of fuel that flows back to the tank which is a function of the power input of the fuel pump. Even in this device, however, an increase of fuel temperature occurs in the fuel tank and a large pump pressure fluctuation is produced due to pressure variation of the switch.

SUMMARY OF THE INVENTION

An object of the invention is to provide a fuel supply system and method in which pressure fluctuations of the fuel delivered to the fuel distributor are minimized, heating of the fuel by the engine is eliminated, and operation of the fuel pump is obtained with an overall reduced power input.

The above and further objects of the invention are achieved by pumping fuel by an electrical fuel pump from a fuel tank to a fuel distributor via a pressure switch and a pressure regulator. The pressure switch is connected to respond to pressure of the fuel pumped by the fuel pump and the switch is electrically connected to the fuel pump to control electrical power supply to the pump as a function of the pressure of the pumped fuel. The pressure regulator is located between the pressure switch and the fuel distributor to reduce the pressure of the fuel to a value which is lower than the pressure of the fuel at the pressure switch. The fuel is pumped in one direction from the tank to the internal combustion engine without return of fuel to the fuel tank.

The pressure switch has upper and lower threshold values at which the fuel pump is respectively deactivated and activated. As a consequence, an operational hysteresis of the pressure switch is produced. However, by providing a variable volume storage chamber in the pressure switch and by disposing the reducing pressure regulator downstream of the switch, pressure fluctuations of the fuel delivered to the fuel distributor are minimized.

In further accordance with the invention, the system incorporates means to prevent backflow of fuel to the fuel tank whereby the fuel only travels in one direction from the fuel tank to the fuel distributor thus preventing return of heated fuel to the fuel tank with the consequent problems caused thereby.

DETAILED DESCRIPTION OF A PREFERRED EMBODIMENT OF THE INVENTION

Figure 1:
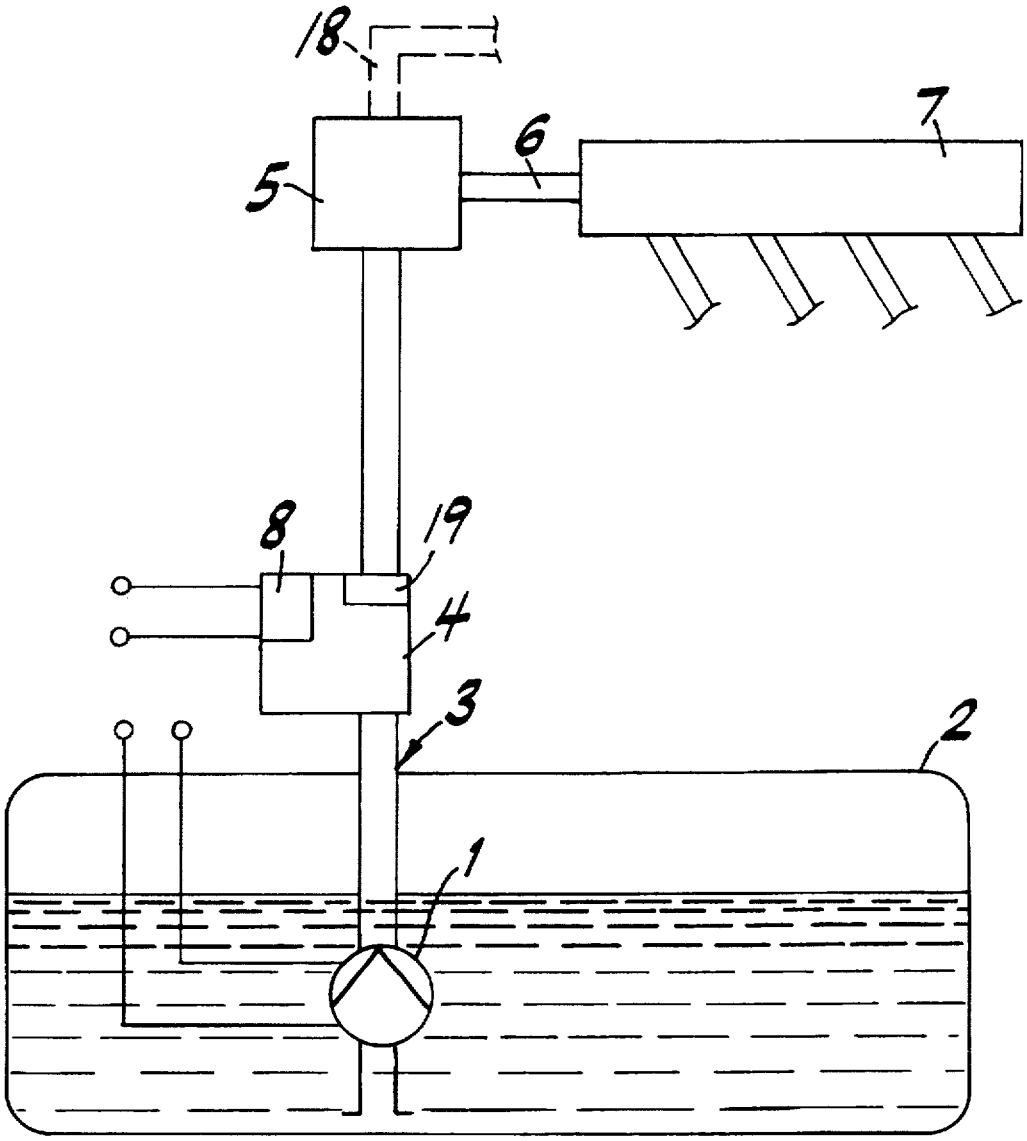
FIG. 1 is a diagrammatic illustration of a fuel supply system according to the invention.

FIG. 1 schematically illustrates a fuel supply system according to one embodiment of the invention for supplying fuel to an internal combustion engine (not shown) and wherein the fuel supply system comprises an electric fuel pump I disposed in a fuel tank 2 for pumping fuel to a fuel line 3 leading to the internal combustion engine. Included in the fuel line 3, is a pressure switch 4 and a reducing pressure regulator 5. An output portion 6 of fuel line 3 connects the output of regulator 5 to a fuel distributor 7 of the internal combustion engine. In this embodiment, the fuel distributor 7 is connected to fuel injectors (not shown) of the internal combustion engine.

In accordance with the invention, the pressure regulator 5 is adjusted so that the pressure of the fuel is reduced to a value which is less than the delivery pressure of the fuel coming from the pressure switch 4.

By reducing the pressure of the fuel in the pressure regulator 5, it is assured that pressure fluctuations in the fuel line 3 coming from the pressure switch 4 do not enter the fuel distributor 7. The pressure regulator 5 can be of any conventional design as is well known to those skilled in the art.

Figure 2:
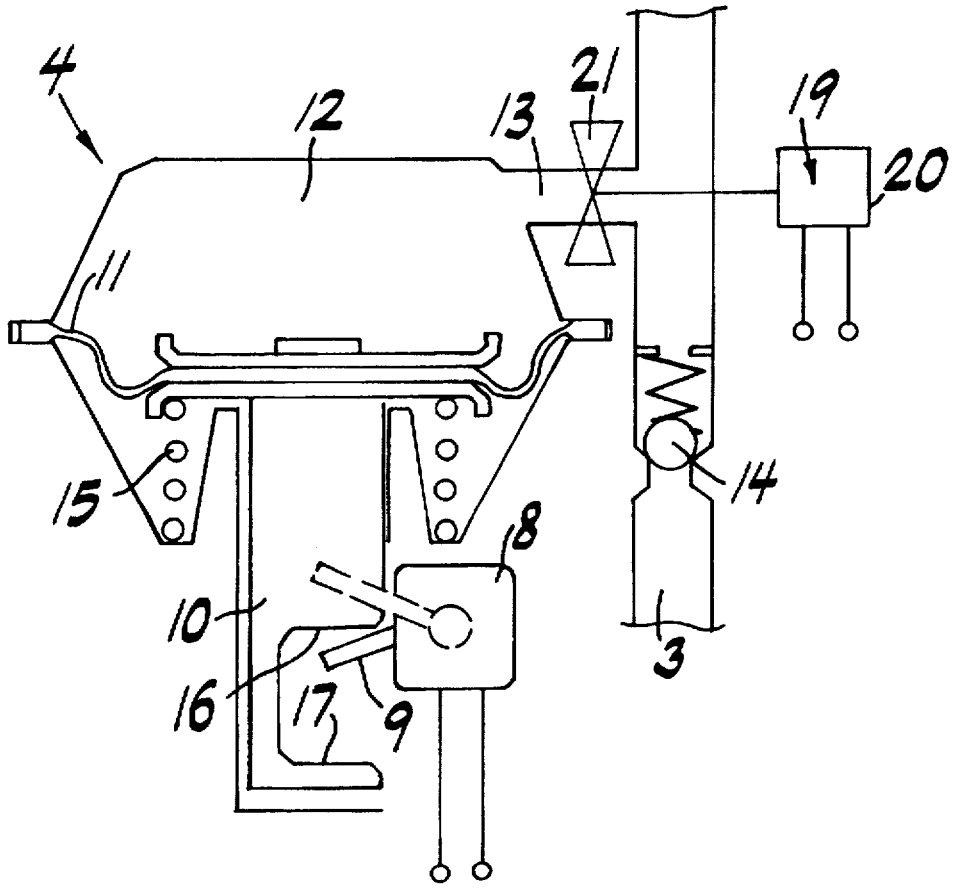
FIG. 2 is an enlarged, diagrammatic, sectional view of a portion of FIG. 1 including the pressure switch therein.

Referring to FIG. 2, therein it is seen that the pressure switch 4 includes a microswitch 8 connected in a circuit (not shown) which controls the activation of the electric fuel pump 1. The microswitch 8 has an actuator arm 9 which is moved between on and off positions of the microswitch 8 by a rod 10 secured to a displaceable member in the form of a flexible membrane 11. The membrane 11 bounds a chamber 12 of variable volume. The chamber 12 is connected by a branch line 13 to the fuel line 3. A check valve 14 is located in the fuel line 3 upstream of the branch line 13 to prevent backflow of fuel to the fuel pump. The fuel pumped by the fuel pump, is conveyed to the pressure regulator 5 via the check valve 14 and the fuel simultaneously enters the chamber 12 of the pressure switch.

The membrane 11 is acted on by a biassing spring 15 with a force so that higher pressure prevails in fuel line 3 than the pressure controlled by the pressure regulator 5. Accordingly, fuel is delivered to the fuel distributor 7 at the desired operating pressure.

When chamber 12 is filled with fuel, rod 10 acts on actuator arm 9 to move it to the open switch position as shown in FIG. 2 in solid lines where operating surface 16 of rod 10 pivotably displaces the arm 9 to its lower position. Accordingly, power input to the fuel pump 1 is interrupted (utilizing an amplifier if necessary) in the electrical supply circuit of the electric fuel pump 1. Fuel stored in chamber 12 is delivered to the engine via fuel line 3 and the chamber 12 has no connection with the fuel tank 2 so that there is no return of fuel from the chamber to the fuel tank. The interruption or deactivation of the fuel pump is maintained until the membrane 11 is urged upwardly by the spring 15 to a position in which the operating surface 17 acts on the actuator arm 9 of the microswitch to pivotably displace the arm to its upper position (shown in dotted outline in FIG. 2), at which the microswitch is closed. At this time, the fuel pump is again activated and the process is repeated.

The check valve 14 prevents backflow of the fuel from the chamber 12 to the fuel pump. Although not illustrated in the drawing, pressure relief valves can be provided in the fuel line 3 at selected locations as is well known to those skilled in the art. The spacing between the operating surfaces 16 and 17, the strength of the spring 15 and the resistance of the membrane 11 establish the switching interval of the microswitch 8. It is further advantageous, according to the invention, to supply the pressure regulator 5 with the inlet pressure of the internal combustion engine via a line 18 as illustrated in dotted lines in FIG. 1.

In accordance with a further feature of the invention, the chamber 12 is closed by a valve assembly 19 when the internal combustion engine is turned off. The valve assembly includes an electrical switch 20 which controls a valve member 21 in branch line 13. When the engine is started, the valve 21 is opened by switch 20 and when the engine is turned off the valve 21 is closed. This serves as a safety feature in the case of accidents. It also reduces the fuel output and prevents fuel delivery from chamber 12 to the fuel distributor 7 when the engine is turned off, thereby preventing uncontrolled input of fuel into the combustion chambers leading to uncontrolled dieseling.

By switching the fuel pump off when the chamber 12 is filled, considerable savings in fuel result in the case of operation with low fuel levels in the fuel tank and when the engine is under partial load as compared to conditions in which the fuel pump must operate at very high capacity against pressure. The capacity of the fuel pump is adapted to the consumption of the fuel by the internal combustion engine.

In this way, low efficiency of the electrical motor of the fuel pump and of the generator producing the current plays a considerable role. Instead of an on off microswitch, a potentiometer can be employed so that voltage dependent switching can be achieved in which power is supplied to the pump during low voltage of the potentiometer and the pump is switched off at high voltage or vice versa.

Although the invention has been described in relation to a specific embodiment, numerous modifications and variations can be made within the scope and spirit of the invention. Thus, for example, the membrane 11 can be replaced by other suitable displaceable member such as a piston.

What is claimed is:

1. A method of supplying fuel from a fuel tank to a fuel distributor of an internal combustion engine comprising:

pumping fuel, by an electric fuel pump, through a fuel line connected between a fuel tank and a fuel distributor of an internal combustion engine;

sensing pressure of the pumped fuel in the fuel line by a pressure switch;

opening and closing an electrical switch element of said pressure switch in response to pressure of the pumped fuel;

supplying said pumped fuel into a variable volume, storage chamber of the pressure switch which changes in volume in response to the pressure of the fuel in the fuel line to open and close said switch element, activating and deactivating said pump when the switch element is closed and opened respectively, reducing the pressure of the fuel in a pressure reducer after the fuel passes the pressure switch and before the fuel is supplied to the fuel distributor of the engine, supplying fuel in said variable volume storage chamber of the pressure switch to said pressure reducer when the switch element is opened and the fuel pump is deactivated without any return of fuel to said fuel tank, and closing communication between said variable volume chamber and the fuel line when the engine is turned off.

2. A fuel supply system for an internal combustion engine comprising:

an electrical fuel pump for pumping fuel through a fuel line from a fuel tank to a fuel distributor;

a pressure switch connected to said fuel line to respond to pressure of the fuel pumped by the fuel pump, said pressure switch being electrically connected to control electrical power supply to said fuel pump as a function of the pressure of the pumped fuel, and a pressure reducing regulator between the pressure switch and the fuel distributor to reduce the pressure of the fuel to a value lower than the pressure of the fuel at the pressure switch, said pressure switch including a variable volume storage chamber connected to receive fuel from said fuel line pumped by said fuel pump, an on-off switch having an actuator arm movable between open and closed states of said switch in response to volume of said storage chamber, said arm being in closed state of said switch when the volume of said storage chamber is low and being in open state of said switch when the volume of said storage chamber is high, said fuel pump being operated when the switch is closed and being deactivated when the switch is open, said storage chamber supplying fuel stored therein to said fuel distributor when said fuel pump is deactivated and being isolated from said fuel tank so that no return of fuel from said storage chamber to said fuel tank takes place, and valve means for controlling fuel flow from said pressure switch, said valve means closing fuel flow from said pressure switch when the internal combustion engine is turned off.

3. A fuel supply system as claimed in claim 1, wherein said pressure switch comprises a displaceable member which undergoes displacement in response to fuel quantity in said storage chamber, and a rod secured to said displaceable member for movement therewith, said rod having two surfaces spaced apart in the direction of movement of said rod and positioned to contact and operate said actuator arm to said open and close said switch respectively.

4. A fuel supply system as claimed in claim 3, wherein said displaceable member comprises a membrane bounding said storage chamber.

5. A fuel supply system as claimed in claim 3, comprising a biassing spring acting on said displaceable member to resist displacement thereof due to increased fuel quantity in the storage chamber.

6. A fuel supply system as claimed in claim 2, comprising a pressure line connected to said pressure reducing regulator, said pressure line delivering to said regulator a pressure of the fuel at an inlet to the internal combustion engine.

7. A fuel supply system as claimed in claim 2, comprising a check valve in said fuel line upstream of said pressure switch to prevent backflow of fuel from said pressure switch to the fuel pump.

8. A fuel supply system as claimed in claim 2, wherein said fuel pump is located in said fuel tank.

9. A method as claimed in claim 1, comprising blocking backflow of fuel from said variable volume chamber to said fuel pump.

* * * * *